US006550615B2

(12) United States Patent
Lingamfelter

(10) Patent No.: US 6,550,615 B2
(45) **Date of Patent: *Apr. 22, 2003**

(54) CONTAINER FOR PROVIDING EASY ACCESS TO BEVERAGE CANS

(76) Inventor: C. Brown Lingamfelter, 920 Depot Rd., Foxborough, MA (US) 01710

( * ) Notice: Subject to any disclaimer, the term of this patent is extended or adjusted under 35 U.S.C. 154(b) by 0 days.

This patent is subject to a terminal disclaimer.

(21) Appl. No.: 09/946,004

(22) Filed: Sep. 4, 2001

(65) Prior Publication Data

US 2002/0029991 A1 Mar. 14, 2002

Related U.S. Application Data

(63) Continuation of application No. 09/542,661, filed on Apr. 4, 2000, now Pat. No. 6,283,293.

(51) Int. Cl.[7] ..... B65D 75/00

(52) U.S. Cl. ..... 206/427; 229/164

(58) Field of Search ..... 206/427, 499, 206/161, 193, 446; 229/164, 117.13, 117.15, 122.1, 122, 108, 229, 237, 238, 240, 242; 221/303, 305

(56) References Cited

U.S. PATENT DOCUMENTS

| | | | | |
|---|---|---|---|---|
| 1,925,102 A | * | 9/1933 | Levkoff | 206/746 |
| 3,228,582 A | * | 1/1966 | Osberg | 229/242 |
| 3,669,251 A | * | 6/1972 | Phillips, Jr. et al. | 229/237 |
| 3,765,527 A | | 10/1973 | Vargo | |
| 3,913,739 A | | 10/1975 | Hennessey | |
| 4,000,811 A | | 1/1977 | Hardison et al. | |
| 4,214,660 A | | 7/1980 | Hunt, Jr. | |
| 4,396,143 A | | 8/1983 | Killy | |
| 4,416,410 A | * | 11/1983 | Herrmann | 229/242 |
| 4,582,199 A | | 4/1986 | Schuster | |
| 4,974,771 A | | 12/1990 | Lavery | |
| 5,137,211 A | | 8/1992 | Summer et al. | |
| 5,465,831 A | * | 11/1995 | Smith | 229/242 |
| 5,775,574 A | | 7/1998 | Whitnell | |

* cited by examiner

*Primary Examiner*—Luan K. Bui

(57) ABSTRACT

A container having a multiplicity of cans therein. The container disclosed is modified from a rectangular, closed wall container to a container with part of the walls removed, thereby allowing easy access to the cans of the container. Applicant discloses a unique relationship between the walls of the opened container and the size of the beverage cans. Applicant also discloses a method for constructing a closed container that may be easily modified to remove the cans of the container.

6 Claims, 3 Drawing Sheets

CONTAINER FOR PROVIDING EASY ACCESS TO BEVERAGE CANS

This is a continuation of application Ser. No. 09/542,661, filed Apr. 4, 2000, now U.S. Pat. No. 6,283,293.

BACKGROUND OF THE INVENTION

1. Field of the Invention

Beverage can containers, more specifically a beverage can container for providing easy access to the beverage cans contained therein.

2. Background Information

Beverages, such as soda or beer, often come in cylindrical, aluminum, typically 12 oz. cans. Traditionally, one could buy a single can or a "six pack." The six pack is simply six cans contained in a typically rectangular paper container or hung on interconnected plastic rings.

More recently, cans of soda and beer have become available in packs of twelve cans. The twelve pack is typically rectangular cardboard with the cans, usually in a 4×3 matrix arrangement, stacked closely next to one another. The twelve pack has walls typically constructed of light cardboard or thick paperboard, being thicker than writing stock paper but not as robust or thick as corrugated cardboard. These twelve packs presently enjoy popularity with use by Coca-Cola and Pepsi-Cola, the two leading providers of soda as well as by many major domestic beer companies.

The twelve pack containers provide a convenient means to carry the beverage cans but are not handy for dispensing the cans. Typically, the consumer will purchase the twelve pack, bring it home, tear the pack open and pull out the cans to stack them in the refrigerator, discarding the container. Applicant provides, however, for a modification to the currently available twelve pack to convert the carrying container to a dispensing container. That is, the cans will remain within the carrying container, the container acting, as modified by applicant as a beverage can dispenser.

An object of Applicant's present invention is to provide for a container for beverage cans which will allow easy access to the beverage cans for easy removal but will also hold the beverage cans therein.

It is also an object of Applicant's present invention to provide a modification to currently existing beverage can containers so that the containers, as modified, will provide easy access to the cans therein.

This and other objects are provided for in a generally rectangular, paper beverage can container with a corner removed on a diagonal line across the two side walls, the line running from a front wall to the adjacent top wall.

There are a number of benefits with Applicant's novel beverage container with a dispensing cutout therein. These include ease of access. This is obtained by placing the twelve pack container on edge with a cutout in the upper corner. Easy and fast accessibility to the cold beverage cans will increase consumption and sales of the product.

Applicant's invention also provides for gravity feed to enhance access to the beverage cans. This is created by the weight of the cans when the beverage container is placed in a vertical position. This position naturally pushes the cans, under the influence of gravity, towards the front wall of the container. The cutout location is designed to take maximum advantage of this gravity feed.

Another advantage of Applicant's invention is the ability to effectively utilize space, especially in a refrigerator or kitchen cabinet. By placement of the cutout in the position indicated, the container may be placed vertically to save space.

DETAILED DESCRIPTION OF THE PREFERRED EMBODIMENT

Line 12A shows the position of a line on the front wall of a beverage container from one side wall to the next, the line being straight and meeting the edge between the front wall and the side wall at a 90° angle. The line 12D shows the position of a diagonal line across each of the two side walls between the front wall and the top wall, lines 12D, at 12B and 12C showing a preferred range of the position of line 12D with respect to the top wall. Line 12E is a line across the top wall, one side wall to the next and perpendicular to the edges of the top wall. The beverage container will be cut through along lines 12A, 12D and 12E to remove section 12 from the rest of the container (See FIG. 1B). The position of lines 12A, 12D and 12E may be premarked, scored (or otherwise weaken) by the manufacturer of the beverage container so as to direct the consumer to the position for cutting and removing portion 12.

Figure 1:
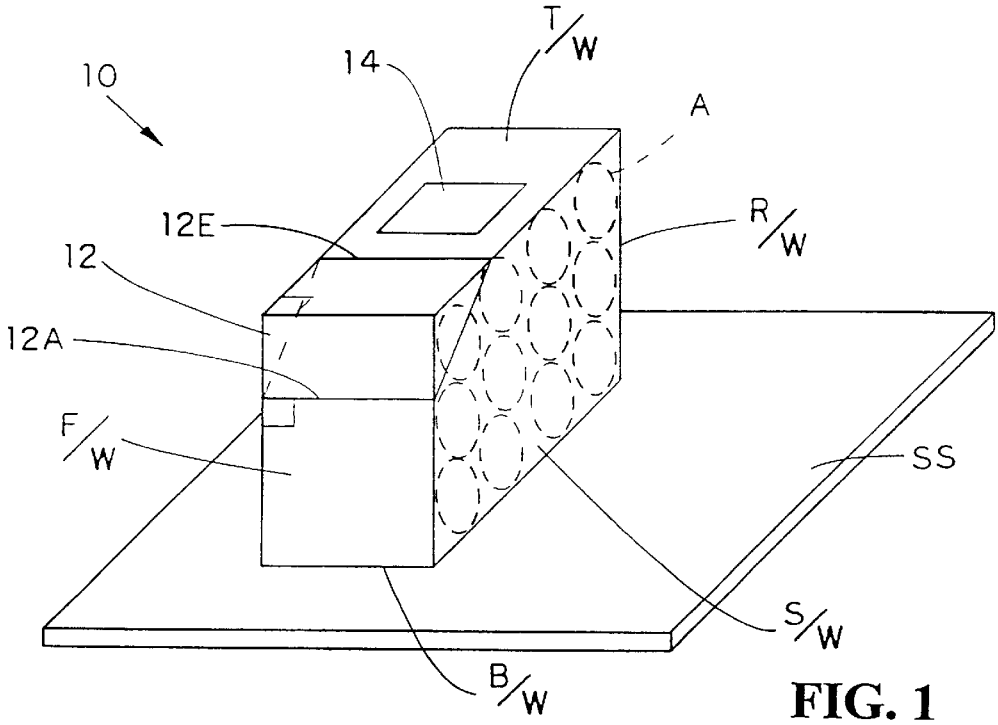
FIG. 1 is a perspective view of the preferred embodiment of applicants invention.
Figure 1B:
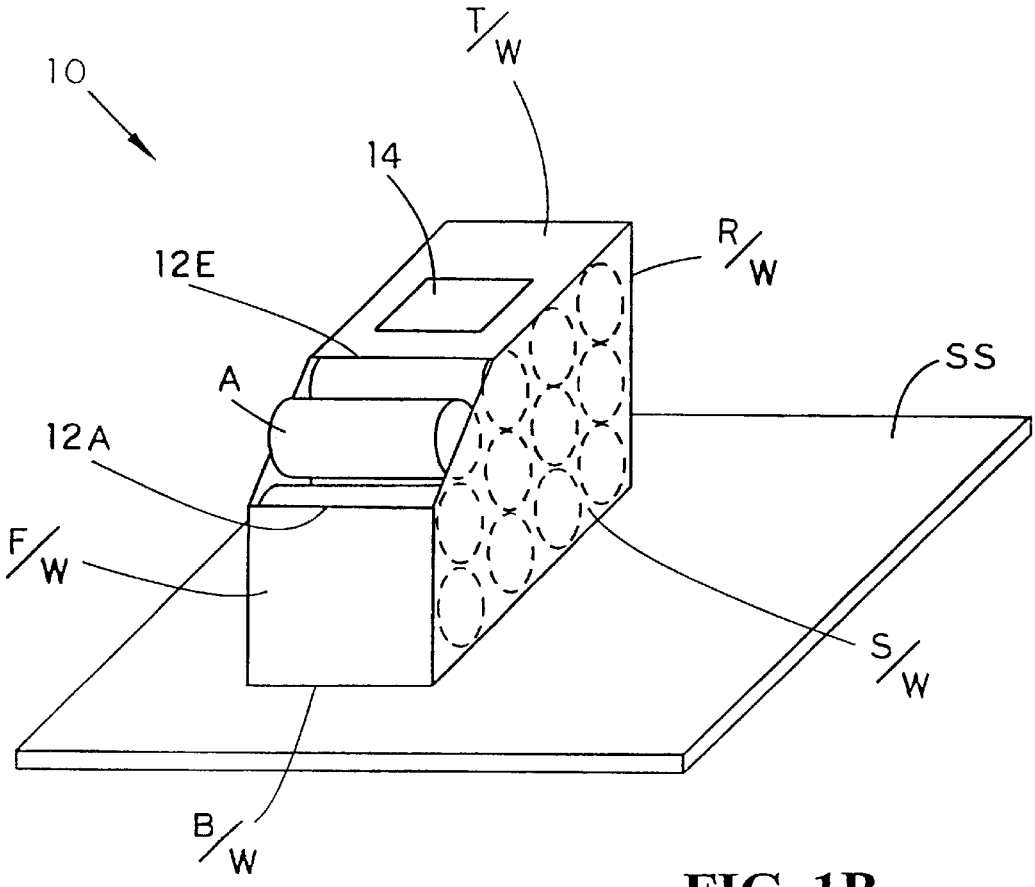
FIG. 1B is a perspective view of the beverage container modified accordingly to Applicant's invention.

FIG. 1 is a perspective view of a modified twelve pack container 10 with cylindrical aluminum 12 oz. beverage cans A packed inside in a 4×3 arrangement and designating two side walls S/W, a top wall T/W, a bottom wall B/W, a front wall F/W and a rear wall R/W. It is noted that the two side walls have the greatest surface area, the top and bottom walls having a surface area between the two side walls and the front and rear walls, which have the least surface area. A support surface, such as a refrigerator shelf, is designated SS. The top, bottom, front and rear walls are defined when the container is placed on a support surface, as illustrated in FIG. 1, with the F/W chosen to provide for the most convenient access. FIG. 1 also illustrates Applicant's modification, being a cut or removed portion 12, the removed portion being a corner of the container where the front wall meets the top wall and defined by a diagonal line across the two sidewalls between the front wall and the top wall, and a line across the top wall and across the front wall, this line along which the removed portion is defined designated 12A.

Figure 2:
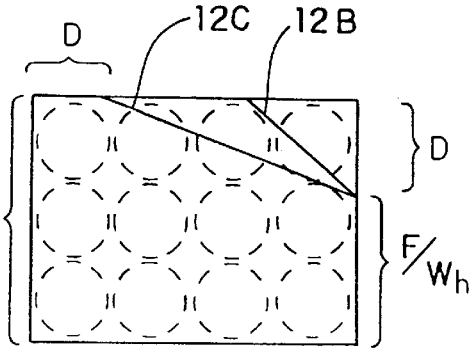
FIG. 2 is a side elevational view of the preferred embodiment of applicants invention.
Figure 1A:
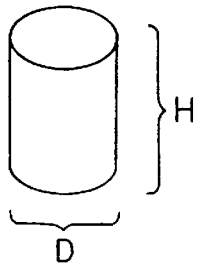
FIG. 1A is side view of a 12 oz. beverage can.

FIG. 2 illustrates a side elevational view of the twelve pack of FIG. 1 wherein the dimension designated D is the approximate diameter of a 12 oz. aluminum beverage can, typically about 6.6 centimeters. As can be seen in FIGS. 1 and 2 the typical twelve pack beverage container is a little over 4 diameters long (about 26 cms) and about 3 "diameters" high (about 20 cms) to enclose therein, in a 3×4 matrix, twelve cans. Furthermore it sometimes includes a handle 14 thereon, the handle typically being walls defining a cut out in the top wall for the receipt of a hand thereinto. The height (H) of a typical 12 oz. metal beverage can is about 12.6 cm.

In FIG. 2 it is seen that Applicant modifies the standard heavy paper wall twelve pack container by cutting off the corner created by the joinder of the front wall and top wall. This is preferably done in the manner illustrated in FIGS. 1 and 2. The preferred height of the front wall defined after the cut across the front wall is less than two diameters but greater than one diameter, more preferably between 1.50 and 1.80 times D. Indeed, the most preferred height of the front wall defining the cut to remove portion 12 is between 1¼ diameter and 1 ¾ diameter. Such dimension allows easy receipt of the second course of cans but is high enough to prevent the second course of cans from falling out when there are still 3 courses in the container.

The preferred length of the top wall defined after the cut is between 1 and 3 diameters, preferably between 1 and 2 diameters. These cut dimensions are illustrated by lines 12B and 12C set forth in FIG. 2.

Cuts along the lines 12A, 12D and 12E may be made with a knife, razor or any other suitable instrument. When the cuts are made as set forth in FIGS. 1 and 2, portion 12 can be removed (See FIG. 1B) and the single can at the top corner will then be removed and the container placed in the position illustrated in FIG. 1 for easy dispensing of the remaining cans.

Figure 3:
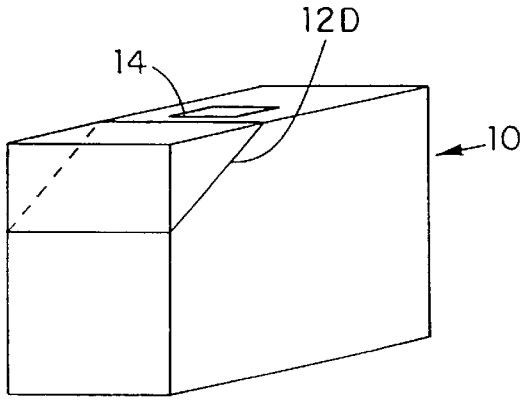
FIG. 3 is a side elevational view of an embodiment of Applicants invention.

FIG. 3 provides for a diagonal cut 12C across the side walls S/W's that terminates adjacent handle 14. Handle 14, in a 4×3 twelve pack is usually at 2 diameters from a top edge (half way across top wall T/W) to provide for proper balance.

Figure 4:
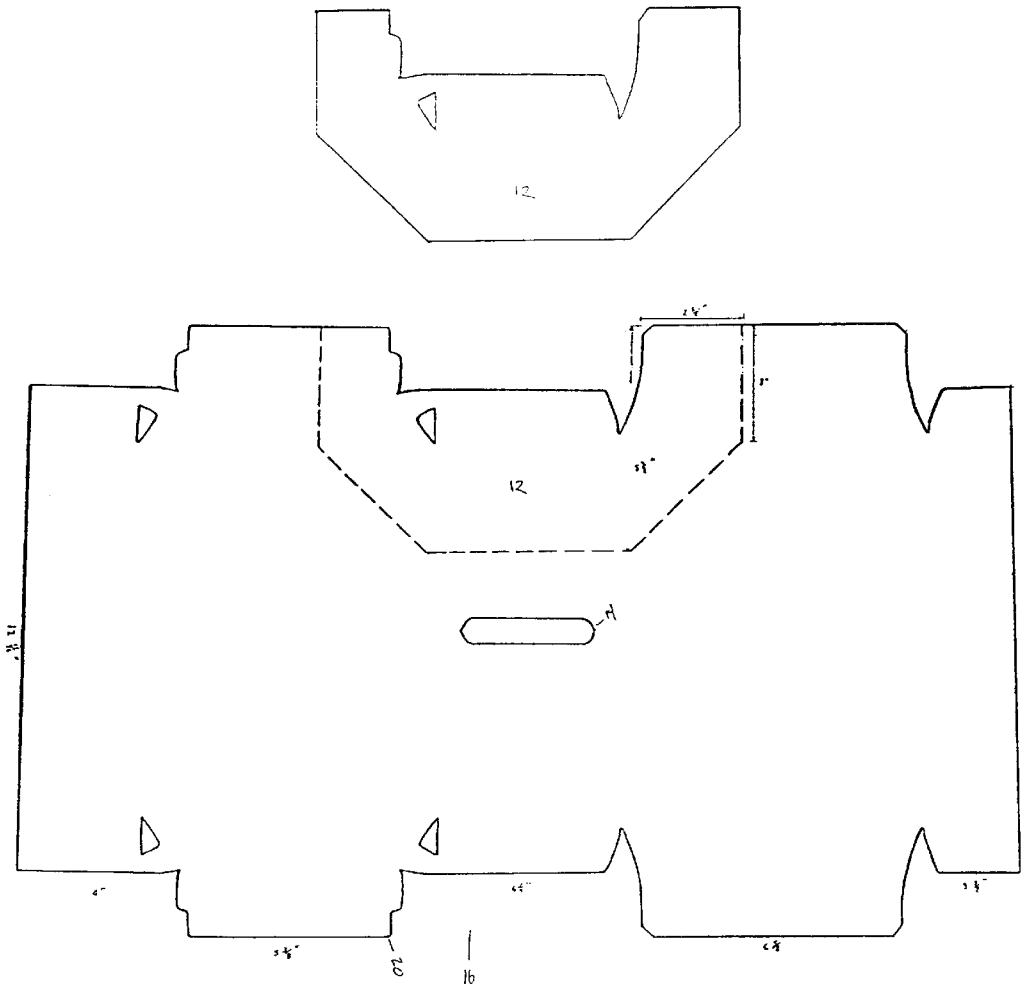
FIG. 4 is a two dimensional pattern of a typical paper twelve pack container illustrating the area removed to provide for applicants unique dispenser.

FIG. 4 illustrates a flattened twelve pack pattern 16 which will fold together to provide for a typical twelve pack with dimension. Handle 14 is illustrated. Scored line 18 is made as part of the process of constructing the container, typically after the outer perimeter 20 defining the pattern 16 of the box is formed. Scored line 18 may be grooves, scratches or notches, or any other means known in the trade to weaken the paperboard such that it is easier for the user to remove portion twelve. Indeed, with proper scoring in ways known in the trade, it is fairly easy to remove portion twelve without a cutting instrument. Note in FIG. 4 that folding the pattern 16 will provide for the twelve pack illustrated in FIGS. 1–3 with the diagonal line 12D running across the side walls from the front wall F/W to the top wall T/W.

In an alternate preferred embodiment Applicant provides a twelve pack container with a line marked on the front wall F/W at between 1D and 2D, on the top wall T/W between 1D and 3D and across the two side walls S/W's to define the pattern for removal of a corner 12 of a twelve pack container as illustrated in FIGS. 1–4 to show a consumer that they may cut the container along the line to convert it into the Applicants novel dispenser container as illustrated.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A container for holding a multiplicity of cylindrical cans, each can of the multiplicity of cylindrical cans being similarly dimensioned and having a diameter and height, the container comprising:

a rear wall with a height defined by a whole multiple of can diameters each can diameter being about 6.6 cm;

a front wall having an upper lip with a height less than the rear wall by a difference of about 1.5 can diameters;

a bottom wall with a length defined by a whole multiple of can diameters;

a top wall with a length at least 6.6 cm less than the length of the bottom wall; and two side walls, the side walls joining the front wall and top wall at angle exceeding about 90° the side walls separated by the height of a can, the height being about 12.5 cm;

wherein the upper lip of the front wall is longitudinal to the longitudinal cans when the cans are within the container.

2. The container of claim 1 wherein all the walls are comprised of having paper.

3. The container of claim 1 further including a handle, the handle defined by a cut out area centrally located on the top wall.

4. A method for modifying a carton for holding a multiplicity of similarly dimensioned cylindrical cans, each can having a diameter and a height, the method of modifying the container as follows:

providing a rectangular paper container having six rectangular walls including two side walls having about the same dimensions and a front wall and a rear wall, the front wall and the rear wall having about same dimensions and a top wall and a bottom wall, the top wall and bottom wall having about the same dimensions and being separated by a distance equal to the height of a can; and scoring some of the paper of the container to define a section of the container, the removal of which will leave the container with a front wall having a height less than the rear wall by a difference of about 1.5 can diameters and a top wall with a length at least 6.6 cm less than the length of the bottom wall; and the side walls joining the front wall and top wall at angle exceeding about 90° the side walls separated by the height of a can, the height being about 12.5 cm.

5. The method of claim 4 further comprising the step of removing the section of the container.

6. A container modified according to the method as set forth in claim 4.

* * * * *